US005925214A

United States Patent [19]

Klein et al.

[11] Patent Number: 5,925,214

[45] Date of Patent: Jul. 20, 1999

[54] DEVICE AND METHOD FOR APPLYING PRESSURE SENSITIVE ARTICLES TO CARTONS

[75] Inventors: Timothy H. Klein, White Bear Lake, Minn.; Craig D. Bakken, Littleton, Colo.

[73] Assignee: Smyth Companies, Inc.

[21] Appl. No.: 08/944,310

[22] Filed: Oct. 6, 1997

[51] Int. Cl.[6] ..... B65C 9/00

[52] U.S. Cl. ..... 156/556; 156/361; 156/542; 156/DIG. 33

[58] Field of Search ..... 156/542, 361, 156/541, DIG. 2, DIG. 33, 556

[56] References Cited

U.S. PATENT DOCUMENTS

| | | | |
|---|---|---|---|
| 4,267,004 | 5/1981 | Anderson | 156/542 X |
| 4,624,734 | 11/1986 | Voltmer et al. | 156/541 |
| 5,200,007 | 4/1993 | Svyatsky | 156/542 X |
| 5,464,495 | 11/1995 | Eder | 156/456 |

*Primary Examiner*—James Engel

*Attorney, Agent, or Firm*—Oppenheimer Wolff & Donnelly LLP

[57] ABSTRACT

The device of the present invention includes a web manipulation mechanism, a label positioning mechanism, and a position mechanism micro-adjuster for orienting a peel tip of the device in space. Because of the micro-adjustment, the device of the present invention is adaptable for use in labeling a wide variety of articles having a wide variety of manufacturing speeds.

22 Claims, 7 Drawing Sheets

DEVICE AND METHOD FOR APPLYING PRESSURE SENSITIVE ARTICLES TO CARTONS

BACKGROUND OF THE INVENTION

The present invention relates to a method and to a device for applying an article with an adhesive component to a carton or other generally planer surface.

An application of small labels to large, flexible bodies, such as cartons and newspapers, has been an expensive, time-consuming and an inaccurate activity. The flexible bodies, such as cartons and newspapers, have been difficult to adhere adhesive articles and align with a labeling device. Furthermore, it has heretofore not been possible to adapt a device for labeling bottles to a device for labeling cartons and newspapers because the cartons and newspapers travel within a particular process at a very different rate from rates of label application to bottles. Typically, this rate is much faster than can be accommodated by a conventional labeling device. The result is improper registration between the carton and the label. The poor registration becomes catastrophic within a very short period of time in a rapid labeling operation. A consequence is a significant loss of production time and maintenance that is required to correct and repair damaged equipment in the label process. Excessive raw label material must be destroyed. Cartons or newspapers may also have to be destroyed.

The Eder patent, U.S. No. 5,464,495, issuing Nov. 7, 1995, describes a method and an apparatus for applying labels to containers and the resulting containers. With this method, containers are transported on rotatable support plates which are arranged in a circle on a rotating turntable. A leading edge of a label is adhered to a container as the container orbits past a vacuum-type label transfer drum. A curved guide which is tangential to the cylindrical body of the container, as the orbiting and rotating container passes, causes the label to wrap completely around the container. One of a circular array of heat-sealing elements which are rotated with the turntable adjacent each support plate is cammed radially outwardly of the turntable into contact with the region on the container where the trailing end overlaps the leading end of the label. This action fuses the ends of the labels together. The cam profile is adjustable in length to keep the time during which the heat-sealing member is in contact with the label ends overlap constant and independent of the rotational speed of the turntable.

SUMMARY OF THE INVENTION

A device for precise delivery of labels of the present invention includes a mechanism for web manipulation, a mechanism for label positioning, and a mechanism for micro-adjustment of the device for precise delivery of labels. The label positioning device interacts with an article such as a carton or newspaper in order to transfer labels from a web to the carton or newspaper.

The present invention also includes a method for applying labels to newspapers or cartons or other articles with a generally planer surface so that the labels have a consistent and precise alignment. The method includes providing a device with a web manipulation, a labeling positioning mechanism and a position mechanism micro-adjuster. A peel tip component of the device is spatially adjusted in a precise manner in order to produce precise alignment of labels to a variety of articles at a variety of manufacturing speeds.

DETAILED DESCRIPTION OF PREFERRED EMBODIMENTS

Figures 1A, 1B:
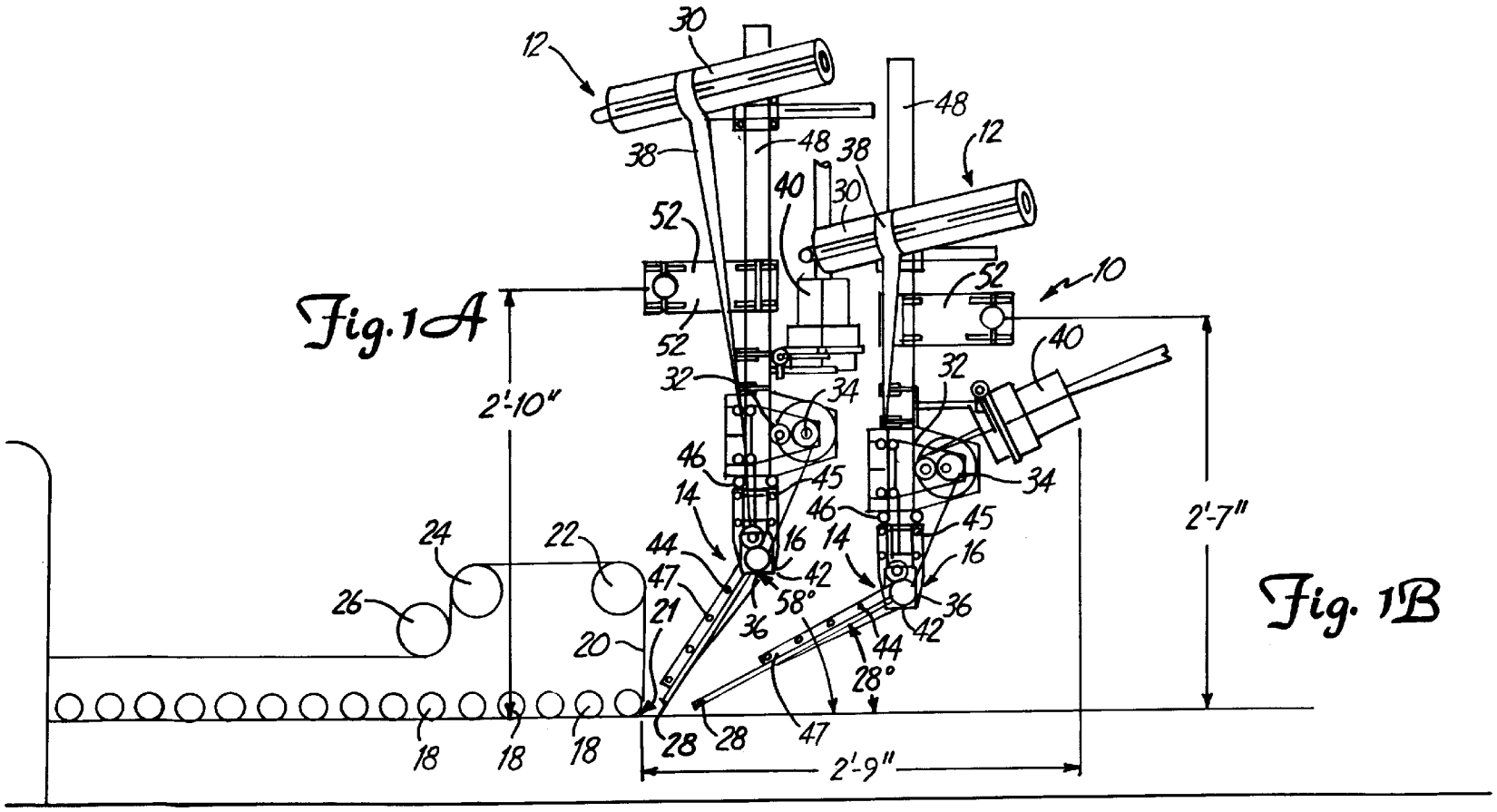
FIG. 1A illustrates an embodiment of the device of the present invention shown in a top plan view.
FIG. 1B shows the device of FIG. 1A in a second position in a top plan view.

The device of the present invention illustrated generally at 10 in FIG. 1A includes a web manipulation mechanism 12, a label positioning mechanism 14 and a position mechanism micro-adjuster 16. The label positioning device 10 of the present invention interacts with an article such as a carton or newspaper conveyed by rollers 18 under a drive belt 20 or roller which is not shown with guide rolls 22, 24 and 26 over a wide range of speeds. More specifically, the label positioning device 10 of the present invention interacts with an article at a nip point 21 which is the point at which the carton or article first passes underneath drive belt 20.

Figures 5, 5A:
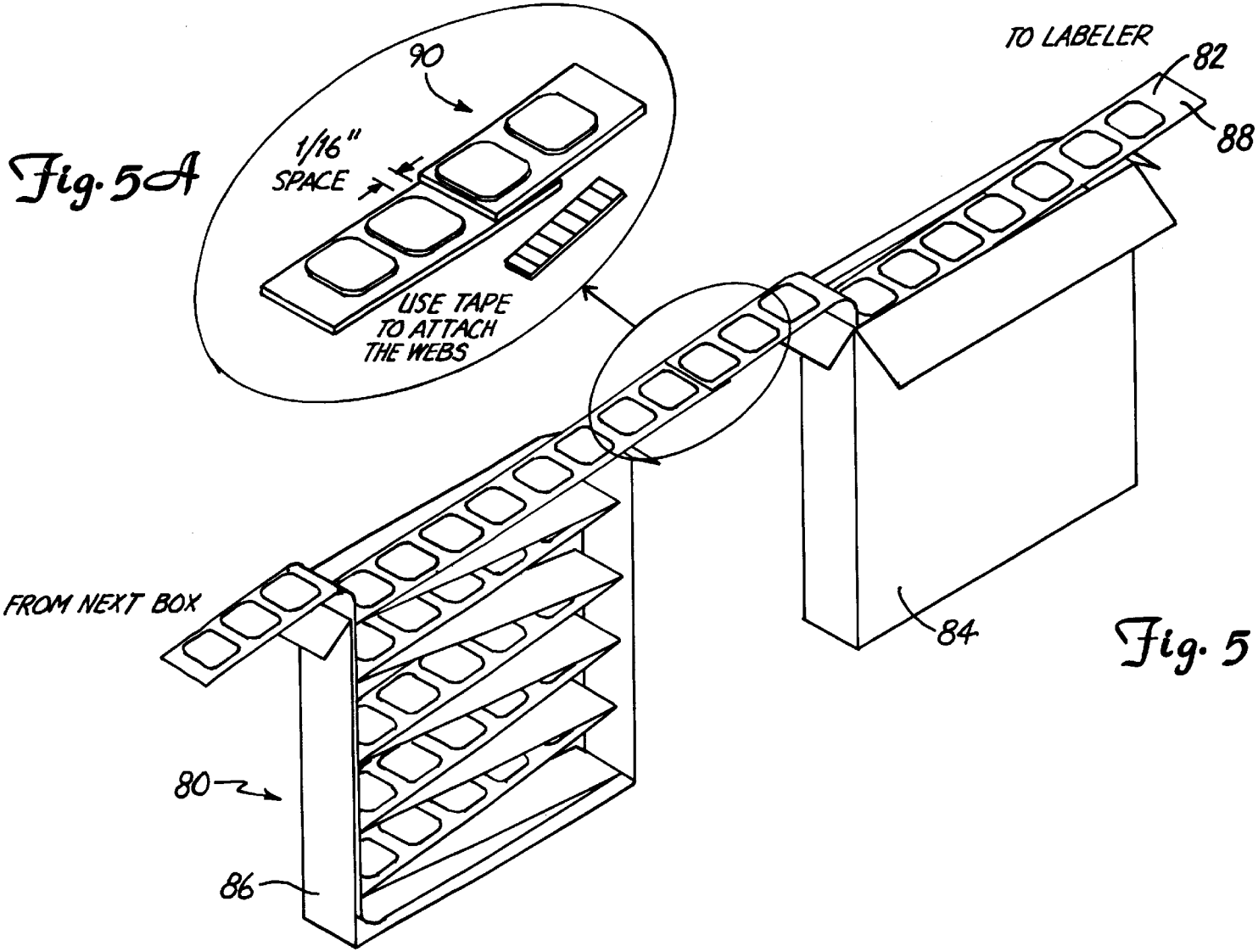
FIG. 5 is one embodiment of a dispenser and storage container for fan folded labels. The dispenser is shown in one perspective view.
FIG. 5*a* is one perspective view of a splice used in conjunction with fan folded label dispensing.

The device of the present invention 10 is spatially adjustable in a very precise manner in order to maintain a constant feed between a label supply such as a continuous feed roll or a fan 15 fold label container, shown at 80 in FIG. 5, and a carton or newspaper even though labels and cartons are moving at very different speeds. The consistent, precise alignment occurs because the label positioning mechanism 14 generally and a peel tip component 28 in particular are precisely positioned so as to constantly, consistently release a label or coupon and position it upon a carton, newspaper or other planer surface.

The device of the present invention 10 utilizes a very different way of viewing the process of label application from what has heretofore been used. Typically, the problem that must be solved in label application devices relates to matching the speed of a label to the speed of an article. Cumbersome articles, such as newspapers or cartons have not been easily labeled at any speed. Successful labeling has typically required low speed operation. The device of the present invention does not rely upon speed matching. Rather, the device of the present invention utilizes precise spatial calibration of delivery components such as a peel tip 28 in order to match a label to the surface of an article such as a carton or newspaper.

One other benefit is that the device 10 may be used to transfer a wide variety of labels to items such as cartons. The types of labels transferable include single component labels in sizes ranging from large to small. Coupon labels and packets may also be transferred with the device of the present invention. Fan folded labels may also be employed. As used herein, labels or coupons refer to any type of article attached to a substrate article. Labels preferably have a pressure sensitive adhesive for binding with the substrate article.

Figure 6:
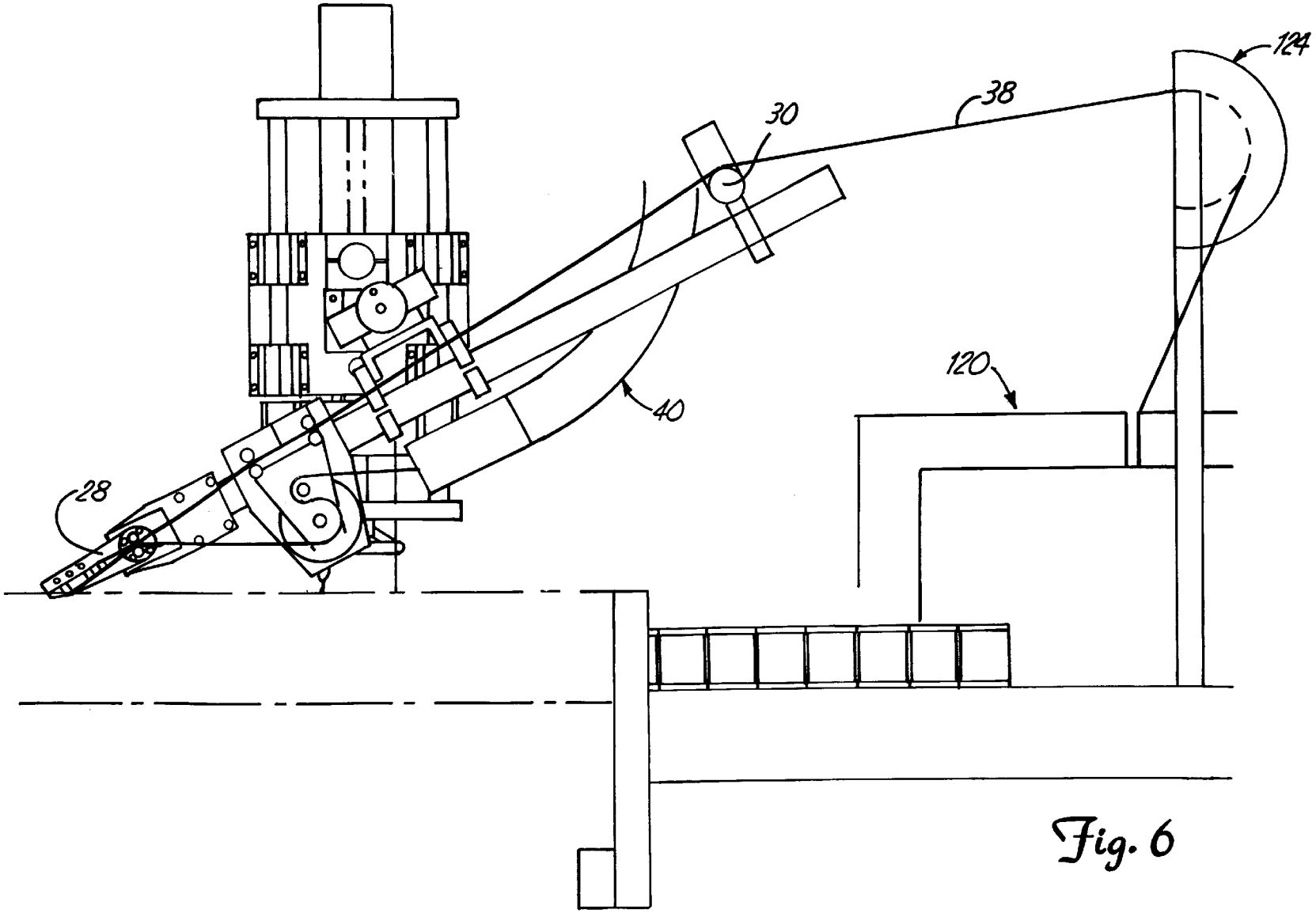
FIG. 6 illustrates a top plan view of a feed of fan folded labels to the device of the present invention.

The web manipulation mechanism 12 includes a web feed component such as a feed spool, which is not shown or a fan folded box, shown at 120 in FIG. 6 with feed roller 124, a venturi liner take-up supply, or a magazine or container for storage of fan-folded webs containing coupons as shown at 80 in FIG. 5. A fan-folded web such as is shown at 82 in FIG. 5 is stored in each of a first box-type container 84 and a second box-type container 86. The web 82 is connected with each of the first box 84 and second box 86 by a series type connection. A mechanism such as a splice illustrated in FIG. 5*a* at 90 may be used to attach two separate webs from the first box and the second box. As can be seen in a cut-away view of the box 86, the web 82 has a fan fold. The leading edge of the web 82 at 88 is fed to the device of the present invention. From the web feed components 120 and 124 in FIG. 6, a web 38 with coupons or labels is passed over a turn bar 30 through alignment rollers 32 and 34, under web guide 36 to the peel tip 28. At the peel tip 28, coupons or labels are separated from the web 38. The web 38 is then displaced away from the device 10 through action of a rewinding mechanism or venturi generating mechanism 40. The web may then be "chopped up" and used for another purpose.

The label positioning mechanism 14 includes the peel tip 28. The peel tip 28 may be adjusted by changing the angle with which the peel tip 28 contacts a horizontal surface and by changing the orientation of the peel tip 28 with respect to the nip point 21. The change in orientation can be accomplished by changing the position of the peel tip 28 and by changing the radial orientation of the peel tip 28. The change in radial position is shown for the embodiment 40 illustrated in FIG. 1B.

The peel tip 28 may be shaped to accommodate a variety of coupons or labels. The tip may be quite sharp or may be blunt, as required. As discussed, the length of the peel tip 28 is adjustable.

The position adjusting mechanism 16 includes knobs 42, 44 and 46. The peel tip 28 position is adjustable by rotation of knobs at 42, 44, and 46. The knob at 42 adjusts the angular position of the peel tip 28 with respect to the horizontal by raising the peel tip 28 or lowering the peel tip 28. The knob 42 is positioned at a hinge where the peel tip 28 is attached to a support frame 45 that is secured to a rail 48.

The knob at 46 adjusts the spatial orientation of the peel tip 28 with respect to a web of cartons or newspapers. In particular, the peel tip 28 may be moved in a linear direction along the rail 48. The peel tip 28 may be moved closer to the carton or newspaper or farther away.

The knob at 44 adjusts the length of the peel tip 28. In particular, the peel tip 28 may be moved within an extender 47 and tightened with the knob 44 to increase or decrease the length as required. The extender 47 defines a series of holes. Screws or other fastening devices may be placed in the holes in order to retain the peel tip 28. The peel tip may be moved incrementally along the extender 47 in order to lengthen or shorten the peel tip 28 as required.

The knobs 42 and 46 permit micro-adjustment of the peel tip 28 because the rotation of each of the knobs imparts a comparatively small movement to the peel tip 28. Thus, an operator can make adjustments in a range of as low as one millimeter with comparatively large radial movements associated with turning one of the knobs of 42 or 46. For instance, in the case of radial movement, an operator may turn knob 42 a full turn in order to adjust movement of the peel tip 28 one degree.

One consequence of this precise micro-adjustment is that the labeling device 10 can accommodate virtually any type of speed of carton or newspaper feed without an addition of other expensive components such as an expensive electronic control scheme. Additionally, the device can accommodate a coupon supply such as a fan folded supply. Further, with the precise micro-adjustment of the present invention, a vacuum is not required.

The device 10 is positioned on the rail 48 such as is shown in FIGS. 1A and FIG. 1B. The rail 48 is supported by a vertical brace, which is not shown, attached to a foot 52.

The micro-adjustment of the device 10 of the present invention permits a wide range of motion and renders the device 10 highly adaptable to a variety of special orientation conditions. This adaptability in particular, enables the device 10 of the present invention in conjunction with conventional coupon labeling device to apply coupons to a web with articles that have typically been very difficult to label in a high speed process such as cartons or newspapers.

Figure 2:
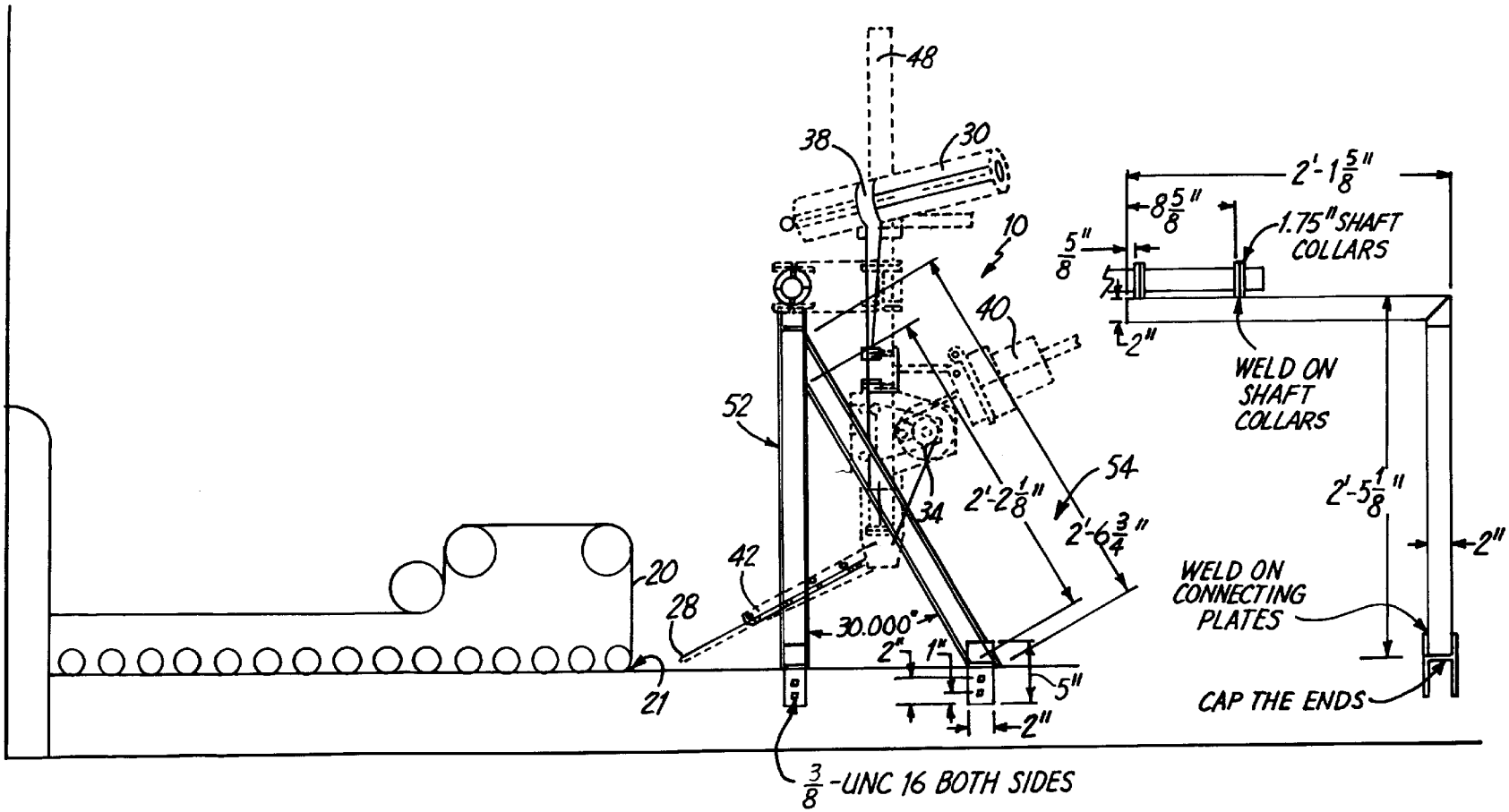
FIG. 2 illustrates one embodiment of the device of the present invention with a mount that includes a separate and additional bracket as compared to the device of FIG. 1A and 1B.

One other mounting embodiment for the device 10 of the present invention in shown at 52 in FIG. 2. The mounting mechanism 52 includes a base 54 and a vertical component, which is not shown, attached to the base. The rail 48 is attached to the vertical component. The device 10 is movably attached to the rail 48. Attachment of the device to the rail may be made by any conventional collar-type attachment mechanism.

Figure 3:
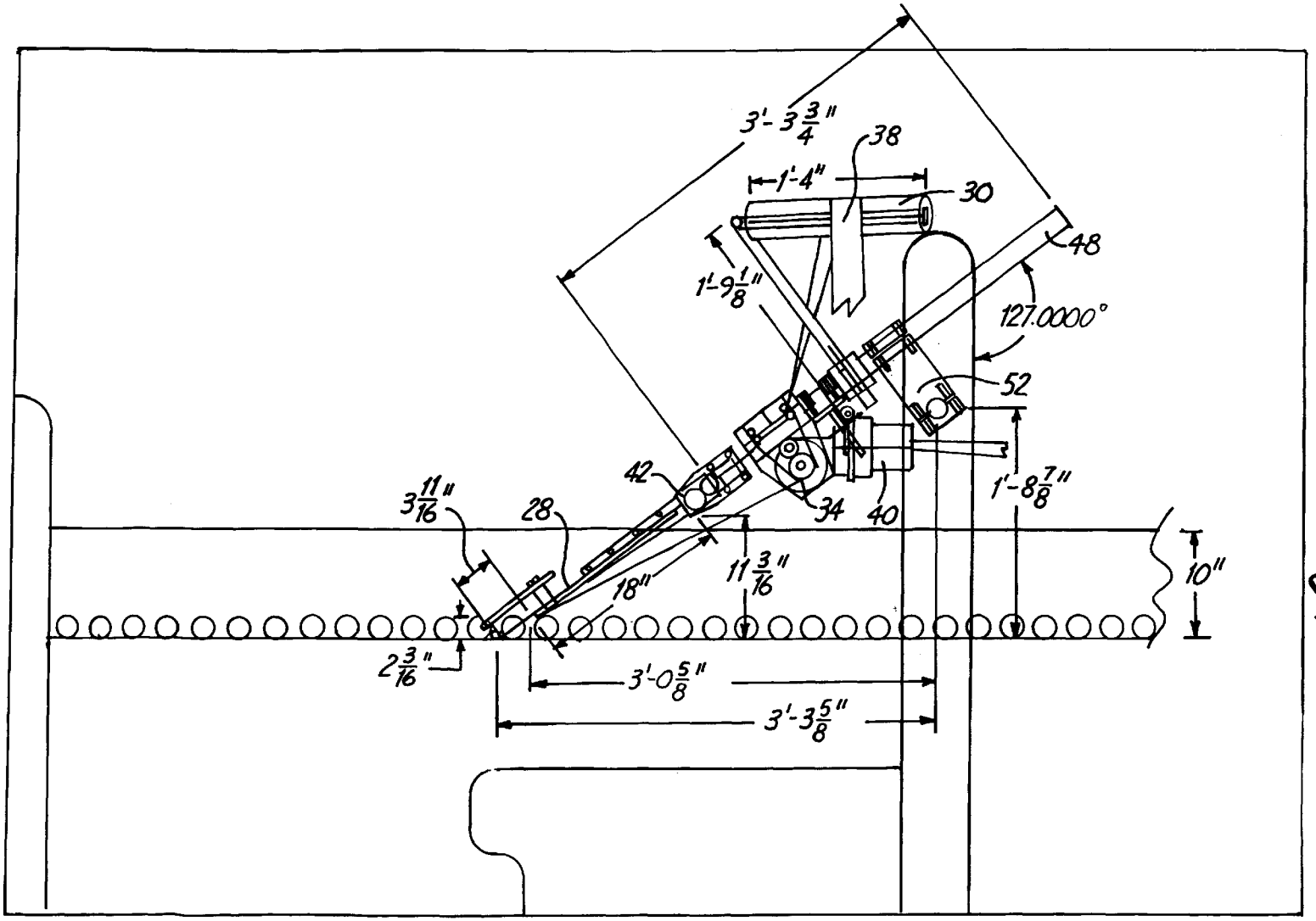
FIG. 3 illustrates a top plan view of one other embodiment of the present invention with a vertical mount attaching to the device at one end of the device.

One other position of the device of the present invention is illustrated in FIG. 3. The peel tip 28 in FIG. 3 is fully extended. Additionally, the rail 48 is a spatial orientation which is very different from the orientation shown in FIGS. 1A, 1B, or 2. FIG. 3 illustrates the versatility in spatial orientation and positioning of the device of the present invention.

Figure 4A:
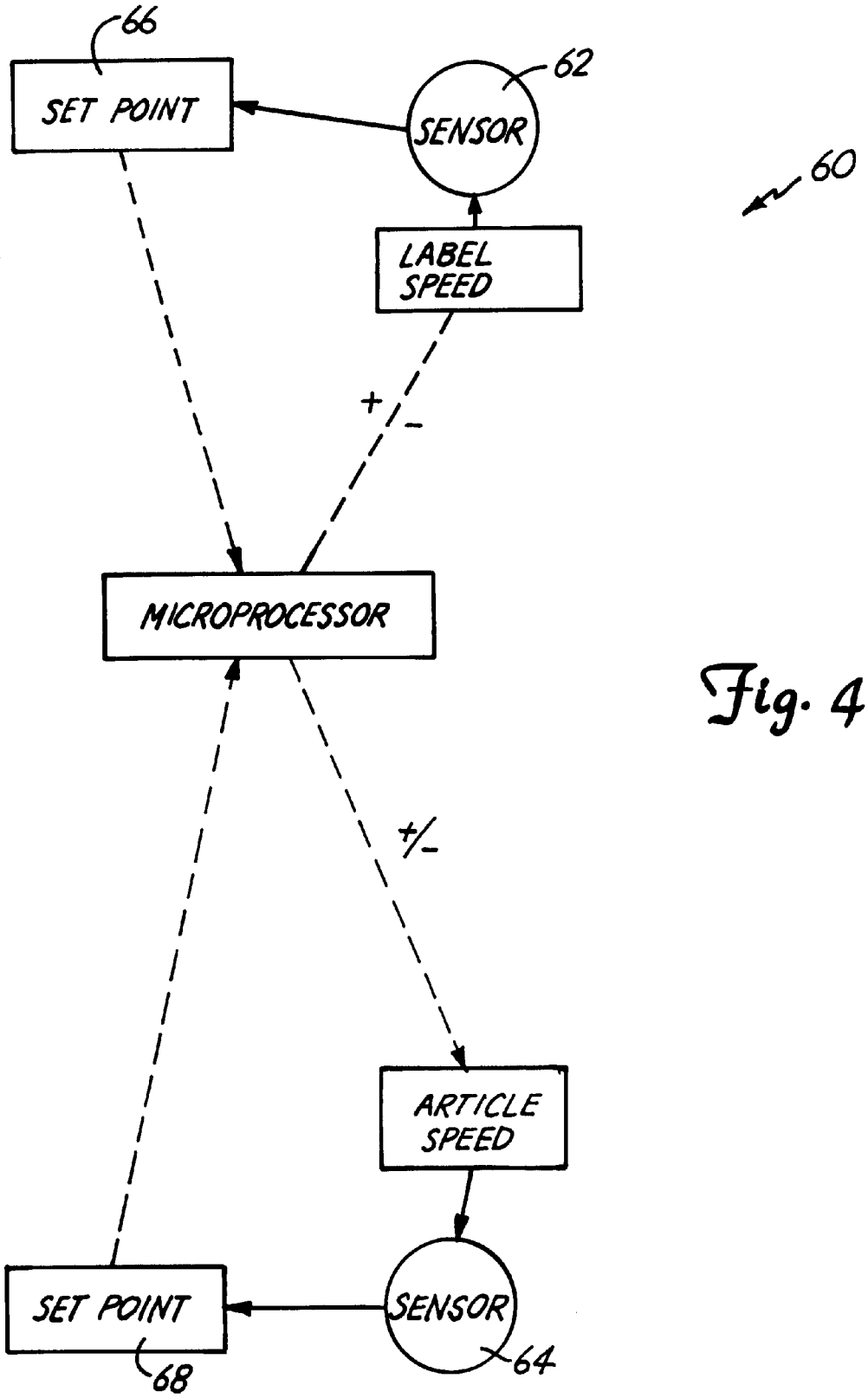
FIG. 4*a* is a schematic view of one embodiment of the servo-control mechanism for the device of the present invention.
Figure 4B:
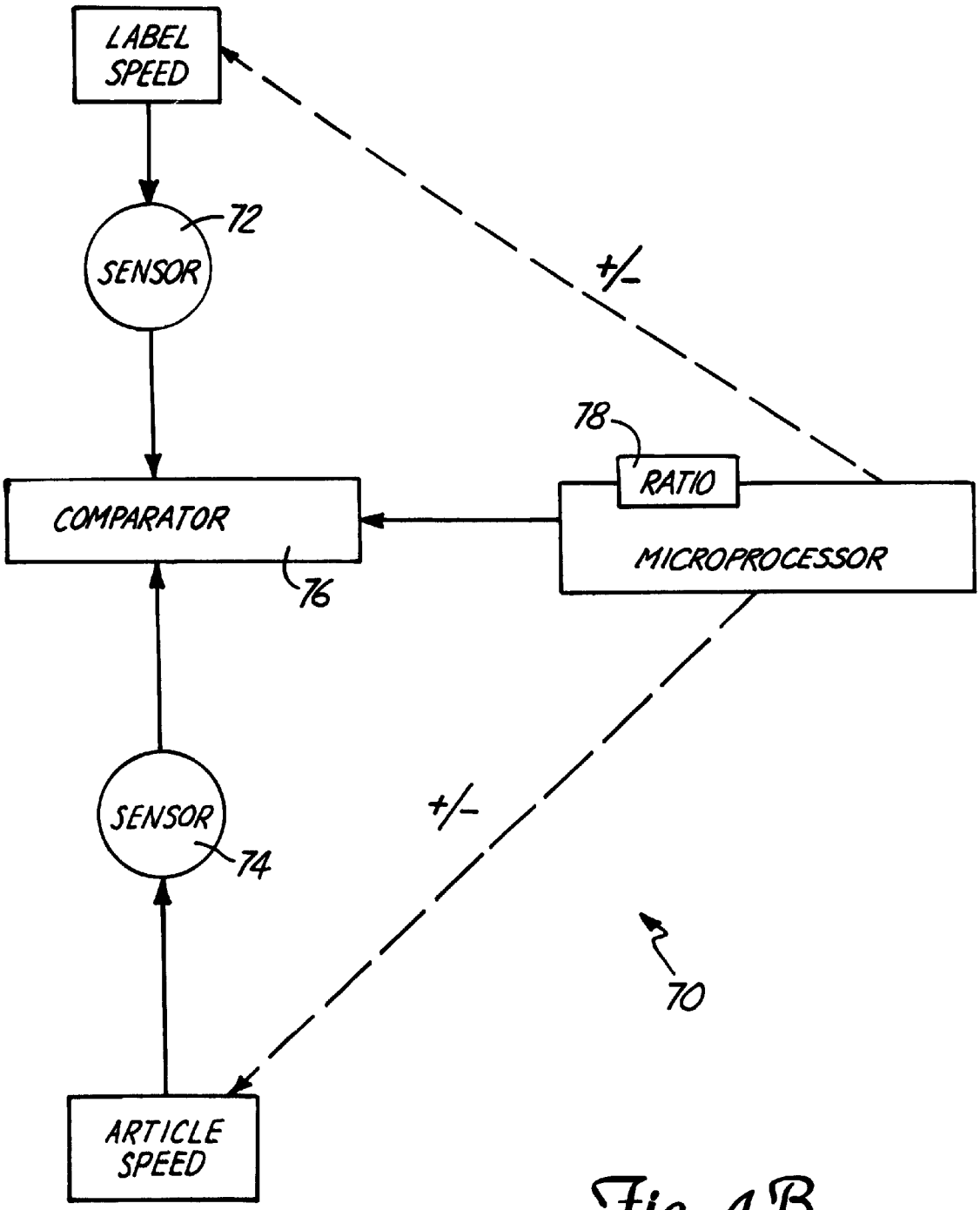
FIG. 4*b* is one other embodiment of the servo-control mechanism for the device of the present invention.

It is also contemplated that the speed of the device of the present invention may be trimmed in a servo-mechanism on a closed loop electrical scheme such as is shown at 60 in FIG. 4*a* and 70 in FIG. 4*b*. With this type of control, a device of the present invention can be controlled so as to increase or decrease speed of web feed in accordance with speed increases or decreases in article feeds such as newspapers or cartons which must be labeled.

One schematic view of an embodiment of the servo-control mechanism shown at 60 in FIG. 4*a* includes sensors 62 and 64 for monitoring label speed and article speed, respectively, and a microprocessor programmed with set points for each of the label speed at 66 and article speed at 68. The set points are established in order to create a ratio of label dispensing speed to article speed.

Another embodiment of the servo-mechanism control, shown at 70 in FIG. 4*b* includes sensors at 72 and 74 for each of the label speed and article speed, respectively. Sensor data is transmitted to a comparator 76. The comparator is programmed with a desired ratio of label speed to article speed as is shown at 78. A controller then commands the device of the present invention to either speed up or slow down in order to match the ratio. The servo-mechanism permits the device of the present invention to remain on-line even when changes are made in the speed of article conveying.

Although the present invention has been described with reference to preferred embodiments, workers skilled in the art will recognize that changes may be made in form and detail without departing from the spirit and scope of the invention.

What is claimed is:

1. A device for applying a label to a moving planar surface of an article comprising:

a peel tip;

means for positioning a web with labels about the peel tip comprising a guide into which the peel tip is positioned for incrementally lengthening or shortening the peel tip; and means for adjusting the peel tip in each of a radial plane and a linear plane.

2. The device of claim 1 and further including conveying means for transferring an article such as a newspaper or carton in proximity to the peel tip.

3. The device of claim 1 wherein the label positioning means comprises a hinge element for adjusting radial rotation of the peel tip.

4. The device of claim 1 wherein the incremented lengthening or shortening of the peel tip is one millimeter.

5. The device of claim 4 and further comprising a rail attached to the frame for spatial orientation of the device.

6. The method of claim 5 wherein the feed web is a fan folded web.

7. The device of claim 1 and further including means for adjustment of a feed speed of the web to coordinate with a different feed speed of moving articles.

8. The device of claim 1 wherein the web is a fan fold type web.

9. The device of claim 1 and further comprising a frame for positioning the means for positioning a web with labels about the peel tip.

10. The device of claim 9 and further including a mechanism for regulating a speed of the web with labels.

11. The mechanism of claim 10 wherein the web speed is adjusted in accordance with a speed of an article such as a newspaper or carton.

12. The device of claim 11 wherein the web speed and the speed of the article are not equal.

13. The mechanism of claim 10 wherein the regulation of the speed is performed by a microprocessor.

14. The device of claim 1 wherein the incremented lengthening or shortening of the peel tip is fully adjustable along the guide.

15. The device of claim 1 further comprising a frame attached to the means for positioning the web, the frame for positioning the peel tip in close proximity to a nip point.

16. The device of claim 1 wherein the web is a roll type web.

17. The device of claim 5 wherein the web is a roll type web.

18. A method for consistently and reliably applying labels to moving objects with a layer planer surface, comprising:

providing a feed web with labels for conveying labels;

providing a moving object along an object carrier such that the object passes through a nip point;

dispensing the label onto the object and over a peel tip wherein the peel tip is adjusted in a radial plane, a linear plane, and along its length to appropriately position the peel tip with respect to the nip point in order to consistently transfer a label to a moving object.

19. An apparatus for the application of labels to an article moving along a carrier structure at a predetermined rate of speed wherein the article passes by a nip point in the carrier structure, the apparatus comprising:

a frame including a rail member;

a peel tip configured to receive a web containing the labels and position the labels at a delivery edge of the peel tip, the peel tip including an extender for adjusting the length of the peel tip; and an adjustable attachment mechanism for attaching the peel tip to the frame, the adjustable attachment member linearly adjustable along the axis of the rail member and rotationally adjustable about an axis perpendicular to the axis of the rail member so as to allow adjustment of the position of the deliver edge adjacent the nip point.

20. The apparatus of claim 19 further comprising a controller to control the advancement of the web so as to coordinate the application of labels.

21. The apparatus of claim 20 wherein the speed at which the web is advancing is not equal to the predetermined rate of speed of the articles.

22. The apparatus of claim 19 further comprising a first adjustment knob and a second adjustment knob, the first adjustment knob configured to control linear adjustment and the second adjustment knob configured to control rotational adjustment.

* * * * *

UNITED STATES PATENT AND TRADEMARK OFFICE

CERTIFICATE OF CORRECTION

PATENT NO. : 5,925,214

DATED : July 20, 1999

INVENTOR(S) : Timothy H. Klein and Craig D. Bakken

It is certified that error appears in the above-identified patent and that said Letters Patent is hereby corrected as shown below:

In Column 1, line 8, delete "planer" and insert – planar – .

In Column 2, line 17, delete "planer" and insert – planar – .

In Column 2, line 41, after the word fan, delete "15".

In Column 2, line 49, delete "planer" and insert – planar –.

In Column 4, line 13, delete "FIGS." and insert – FIG. – .

In Column 4, line 23, after the word invention, delete "in" and insert – is – .

In Column 4, line 38, delete "on" and insert – or – .

In Column 6, line 2 of Claim 18, delete "planer" and insert – planar – .

Signed and Sealed this

Fourth Day of January, 2000

*Attest:*

*Attesting Officer*

*Acting Commissioner of Patents and Trademarks*